United States Patent [19]

Zang

[11] Patent Number: 4,817,338

[45] Date of Patent: Apr. 4, 1989

[54] GRINDING HEAD FOR A MACHINE FOR GRINDING HELICALLY GROOVED CUTTING TOOLS

[76] Inventor: Volker Zang, Westerheimer Strasse 30, D-7903 Feldstetten, Post Laichingen 4, Fed. Rep. of Germany

[21] Appl. No.: 917,403

[22] Filed: Oct. 10, 1986

[30] Foreign Application Priority Data

Oct. 31, 1985 [DE] Fed. Rep. of Germany ..... 3538795

[51] Int. Cl.[4] ..... B24B 3/00

[52] U.S. Cl. ..... 51/48 HE; 51/287; 51/52 R

[58] Field of Search ..... 51/287, 288, 481 HE, 51/52 R

[56] References Cited

U.S. PATENT DOCUMENTS 3,680,263 8/1972 Johnson ..... 51/288

*Primary Examiner*—Frederick R. Schmidt
*Assistant Examiner*—Lawrence Cruz
*Attorney, Agent, or Firm*—Toren, McGeady & Associates

[57] ABSTRACT

A grinding head for a tool grinding machine is used for grinding helically grooved cutting tools. The grinding head includes a rotatable spindle supported by adjustable carriages or slides so that it can be reciprocated along one axis and pivoted about another axis perpendicular to the one axis. Further, it can be pivoted about a third axis disposed perpendicularly to the another axis. The adjustable carriages are supported on a carrier of a grinding head column so that the grinding head can be displaced about a pivot point for adjusting the head to the diameter of the tool being grooved and for adjusting the rake angle about the pivot point.

5 Claims, 3 Drawing Sheets

XD1
X2
XD2
ZS3
ZS4
WD1
WL2
X1
WD2
16
9
8
WL1
15
24
26
Z2
D3
D2
19
ZS2
D1
ZS1
D4
21
20
D3
25
27
17
29
10
(Z2')
11
18
Z1
D2
7
13

GRINDING HEAD FOR A MACHINE FOR GRINDING HELICALLY GROOVED CUTTING TOOLS

BACKGROUND OF THE INVENTION

The present invention is directed to a grinding head used in a machine for grinding helically grooved cutting tools. The grinding head includes a rotatable spindle with carriages supporting the spindle so that it can be displaced about a pair of perpendicular axes. The grinding head can be reciprocated along one axis and it can be pivoted about another axis.

In a known universal tool grinding machine in addition to the vertically arranged grinding head carrier, a grinding table is used for supporting the tool carrier and the grinding table is supported so that it can be pivoted about a vertical axis while the table moves reciprocally or back and forth in the horizontal direction. The grinding table supports the grinding head carrier. The workpiece to be ground is adjusted by the tool carrier with reference to a grinding disc so that the surface to be ground coincides with a horizontal pivot axis of a surface plate defined by a stop projection. The grinding disc is adjusted by carriages or slides so that it contacts the surface of the workpiece to be ground before the grinding process can be carried out. If the grinding disc in such a grinding head is adjusted to the helix angle of the cutting tool, the working point of the grinding disc moves out of the axial center and intersects the cutting tool perpendicularly relative to the rotational axis during subsequent grinding, since the grinding disc can be moved along the vertical Z-axis of the grinding head during the grinding operation. Accordingly, a desired rake angle can be achieved only by approximation of simultaneous adjustment in the direction of the Z and Y axes. Previously, the extent of the adjusting motions were determined only by sample grinding of a cutting tool and taking subsequent measurements and making repeated corrections in the adjusting values. In other words, if the forward feed movement of the carriages must be adjusted to the diameter of the tool to be ground, but are referred to the axial center of the tool in the previously known arrangement, the rake angle of helically grooved cutting tools can be ground only in an approximate manner in such a tool grinding machine. Further, varying rake angles are produced in the cutting tool in numerically controlled grinding operations.

SUMMARY OF THE INVENTION

Therefore, the primary object of the present invention is to provide an improvement of the grinding head of the previously known grinding machine so that the grinding of the rake angle of helically grooved cutting tools can be effected by a single adjusting movement along a single axis of the carriage mounting the grinding disc based on the center of the cutting tool and its diameter for effecting a linear contact between the face of the cutting tool and the grinding disc so that the adjusting movement of the grinding disc does not change the rake angle of the cutting tool.

In accordance with the present invention, a further axis for adjusting the rake angle is provided with such axis being adjustable perpendicularly to the diameter of the cutting tool and with the grinding head being securable in the adjusted position.

In accordance with the positioning of the grinding head according to the present invention, the adjustment of the rake angle is effected about a pivot axis which, in turn, is adjustable relative to the diameter of the tool being ground, whereby the originally adjusted rake angle is retained during the adjusting movement of the grinding disc In this manner the grinding of a desired rake angle in a helically grooved cutting tool can, for the first time, be accurately reproducible, for example according to scale, and for the first time can be automated. Distortions in the ground surface, for example in conical cutting tools, can be compensated, since the pivot axis can be readjusted during grinding, such as by the use of stepping motors. Another advantage is that the sharpening of the grinding disc which is true to the desired shape can be provided by the same adjusting means.

A grinding head is known from the German Patentschrift No. 920 050 in which the spindle carrying the grinding disc is mounted in a shaft support which can be pivoted around an axis intersecting the spindle axis at a right angle with the shaft support carried by a forward feed carriage which can be reciprocated along a horizontal axis. The forward feed carriage can be mounted on a cross-piece for pivotal movement around a vertical axis and the cross-piece can be pivoted around a horizontal axis whereby the cross-piece is supported by a carriage for reciprocal movement at a vertical surface plate which, in turn, can be rotated about the horizontal axis to enable the desired adjusting movements of the grinding disc in accordance with a desired clearance angle of the workpiece being ground.

Regardless of the face that only the clearance angle at the front side of the so-called cutter heads can be ground by this grinding head so as to be true to shape, the carriage supporting the grinding spindle can be pivoted only around a stationary axis and, therefore, can not be adjusted to the axial center of a helically grooved cutting tool or to its diameter. In such a construction the same rake angle errors occur during the grinding of helically grooved cutting tools as were mentioned above.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 3:
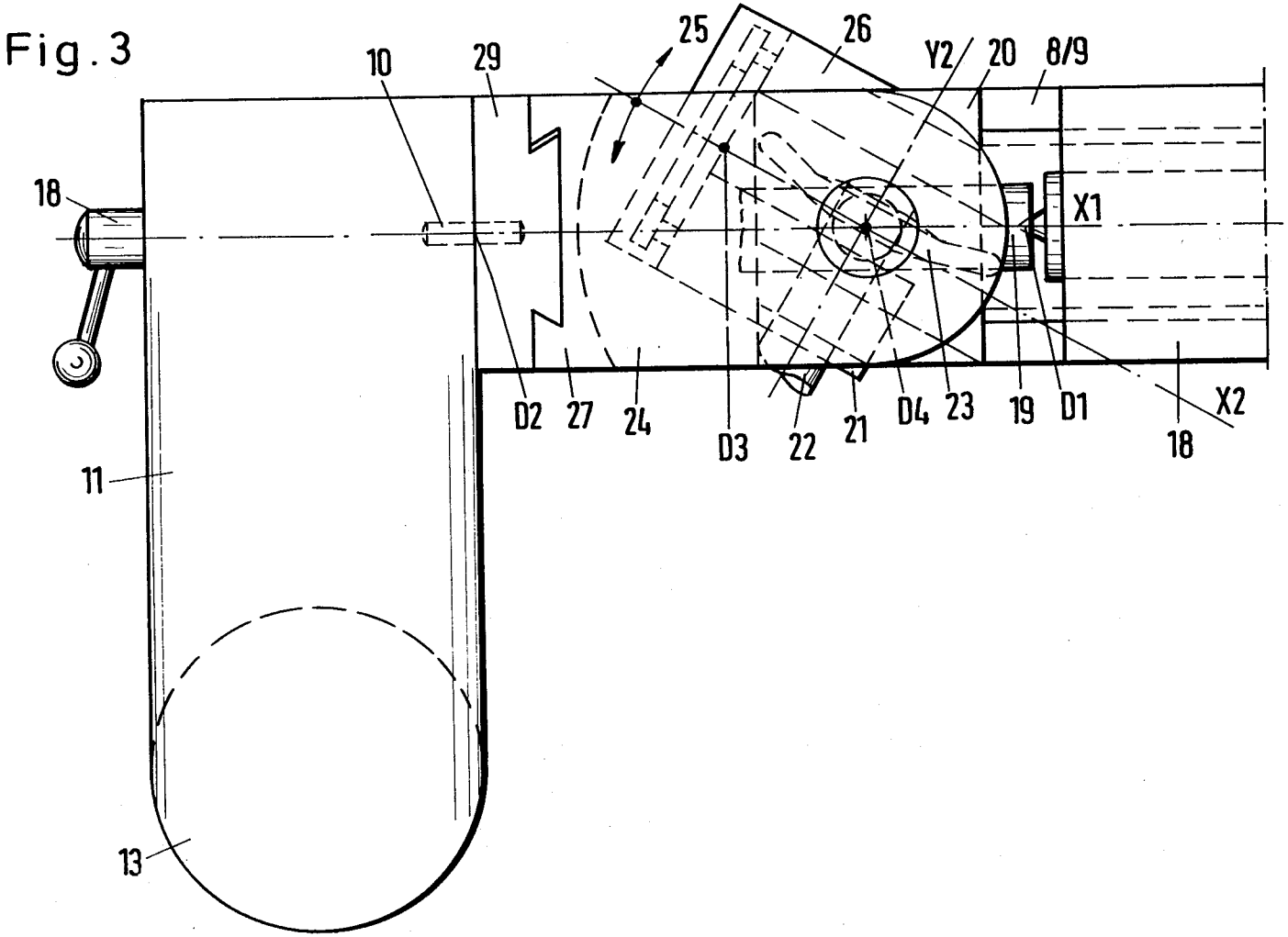
FIG. 3, is a plan view of the tool grinding machine displayed in FIG. 1.

In the drawing, a tool grinding machine 7 is mounted on a support 6, not shown in detail, and includes a carriage bed 8 for an elongated carriage 9 and a vertically adjustable grinding head column 13 acting as a carrier for the grinding head 15. The grinding head column 13 includes an angled supporting arm 11, note FIG. 3.

Figure 2:
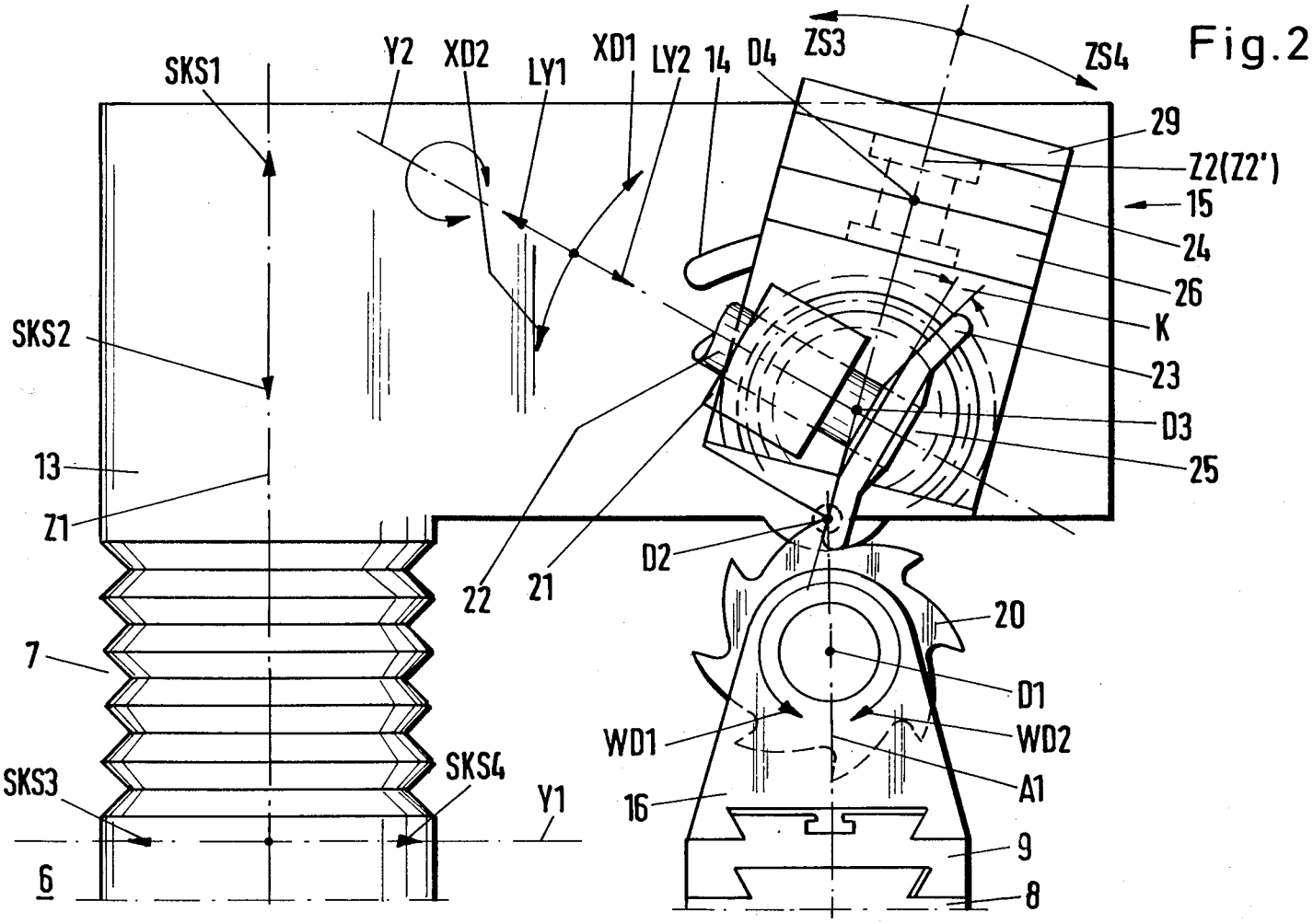
FIG. 2 is a front view of the tool grinding machine illustrated in FIG. 1.

A head stock 16 and a corresponding tailstock 17 are supported on the elongated carriage 9 and are arranged to support a workpiece to be ground. The workpiece is a so-called spiral-fluted cylindrical cutter or roll cutter 20 mounted on a spindle 19 and held between the head stock and the tailstock. Drives, not shown, which can be numerically controlled, reciprocate the head stock 16 and tailstock 17 for the workpiece so that the workpiece can be reciprocated in the direction of the arrows $WL_1$ and $WL_2$ along an axis $X_1$ and can also be rotated about the axis in the direction of the arrows $WD_1$ and $WD_2$. Grinding head 15 has a spindle 22 rotatably supported on an adjustable carriage 21 and a grinding disc 23 for the respective workpiece is mounted on the spindle. The grinding disc 23, as shown in FIG. 2, has a angle of inclination K of its radially outer annular part surface relative to the planar central part. The carriage 21 moves back and forth or reciprocates in the direction of arrows $LY_1$, $LY_2$, note FIG. 2, along an axis $Y_2$. The carriage 21 is supported on an angularly pivotal carriage 25 so that it can be rotated around an axis $X_2$ in the direction of the arrows $XD_1$ and $XD_2$ and intersects the point $D_3$. The pivotally displaceable carriage 25 is supported by a cross arm 26 mounted on arm 24 extending transversely of an adjustable carriage 27 so that it can be pivoted around an axis $Z_2$ in the direction of the arrows $ZS_1$ and $ZS_2$ with the axis $Z_2$ intersecting the point $D_4$. The adjustable carriage 27 is supported for movement upwardly and downwardly in a carriage guide 29 in the direction of the axis $Z_{2'}$. The carriage guide 29 is arranged to be pivoted about a pivot point $D_2$ formed by a spring pin 10 mounted in the supporting arm 11 in a semi-circular groove 14, note FIG. 2, located in the arm 11 of the grinding head column 13 so that it can be pivoted relative to the axis $Z_2$ in the direction of the arrows $ZS_3$ and $ZS_4$. The carriage guide 29 can be secured in the selected adjustable position by a T-screw or capstan-head screw 18.

Grinding head column 13 is supported for movement along an axis $Z_1$ so that it can be moved up and down, as mentioned above, for reciprocation in the direction of the arrows $SKS_1$ and $SKS_2$ and also along an axis $Y_1$ in the support 6 for movement in the direction of the arrows $SKS_3$ and $SKS_4$.

With the arrangement of the different carriages and their supports as well as their adjustability, it is possible to align the grinding disc 23 with the axis $X_1$ which extends through the axial center $D_1$ of the tool to be ground and also with the point $D_2$ located on the diameter of the tool being ground so that the point $D_2$ is positioned vertically above the axis $X_1$ with the point $D_2$ located along an axis extending through the point $D_2$ defined by the pin 10 and corresponding to the desired rake angle of the tool to be ground. The adjustment effected by pivoting in the direction $ZS_3$ and $ZS_4$ of the carriage guide 29 is secured by tightening the T-screw 18. Further, grinding disc 23 can be pivoted around the point $D_3$ on the axis $Y_2$, for corresponding its angle of inclination radially outer annular part surface to the point $D_2$ and aligned with the axis $Z_2$, by means of pivotally displaceable carriage 25, note FIG. 2, that is, by pivoting the disc 23 by means of the carriage 25. Only after these adjustments are made, the grinding disc is driven in the usual manner over the adjustable carriage 27 to produce the desired cutting surface. Accordingly, the axis $Z_{2'}$, as shown in FIG. 2, is the corrected adjustable axis corresponding to the rake angle to be produced.

As can be seen in FIG. 2, the point $D_2$ is the intersection between the axes $A_1$ and $Z_2$ with the axis Al intersecting the center point $D_1$ of the tool 20 to be ground, while the axis $Z_2$ intersects the pivot point $D_4$ for the adjustment of the angle of slope corresponding to the slope of the helical grooves in the tool 20, the point $D_3$ for the adjustment of the surface with the angle of inclination K of the grinding disc 23, and the point $D_2$ forming the pivot point for the adjustable carriage 29, accordingly, these axes define the rake angle of the tool 20 to be ground. The annular part surface of the grinding dis 23 is at the angle of inclination K to the planar central part of the disc.

As a result, grinding disc 23 is supported to be pivoted around another axis $Z_{2'}$, (pivot point $D_2$), located in the neutral position so as to be axially parallel with the axis $Z_1$ while it is supported to be rotatable (rotating point $D_4$) only around axis $Z_2$ by means of the carriages 21, 24, 26, 27 and 29. Moreover, the grinding disc is adjustable around the axis $Y_2$ for correcting its angle of taper, that is, around pivot point $D_3$.

Figure 1:
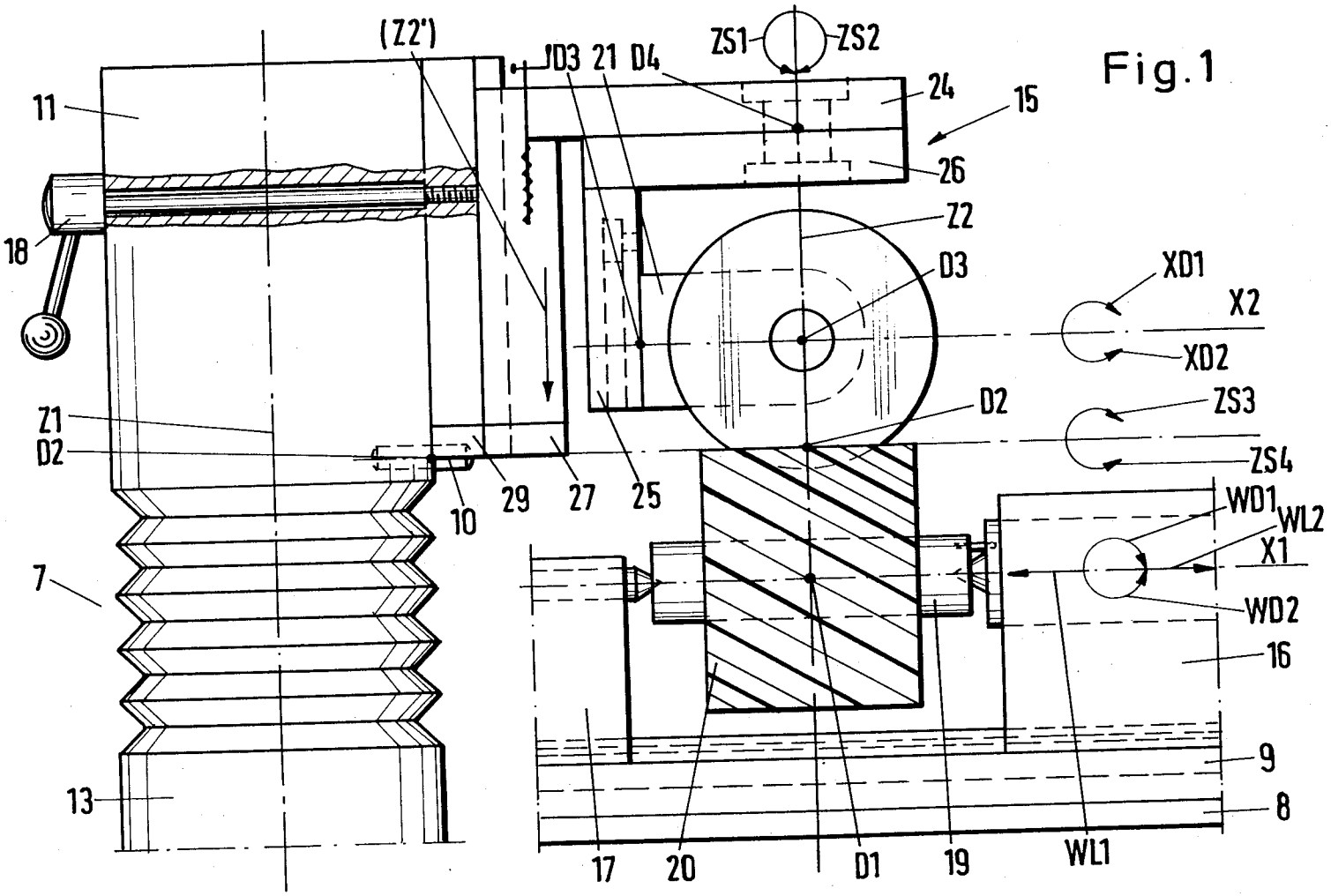
FIG. 1 is a side view, partly in section, of a part of a tool grinding machine embodying the present invention including a grinding head column, a grinding head and a workpiece head stock.

Further, as is known, the spacing of the axes $Z_1$ and $A_1$, note FIG. 2, as well as the spacing of the pivot points $D_1$ and $D_2$, note FIG. 1, can be checked by means of guides fixed on the machine frame which guides may carry markings readable electronically or opto-electronically for the purpose of numerical control of the grinding head.

While specific embodiments of the invention have been shown and described in detail to illustrate the application of the inventive principles, it will be understood that the invention may be embodied otherwise without departing from such principles.

I claim:

1. Grinding head for a tool grinding machine for use in grinding helically grooved cutting tools, comprising a rotatable spindle (22), grinding means (23) mounted on said spindle, an adjustable first carriage (21) supporting said spindle and being displaceable relative to a pair of perpendicularly arranged axes, said pair of axes comprises a first axis ($Y_2$) with said first carriage being reciprocal along said first axis and a second axis ($X_2$) with said first carriage being pivotable about said second axis, wherein the improvement comprises said first and second axes intersecting at a first point ($D_3$), a third axis ($D_2$) spaced from the first point ($D_3$) and the second axis ($X_2$) and parallel to the second axis for adjusting the rake angle of a cutting tool (20) to be ground, means for rotatable supporting the cutting tool about a central axis ($X_1$) parallel with the third axis, means for adjusting said third axis ($D_2$) perpendicularly relative to the central axis ($X_1$) of the cutting tool, and said third axis being securable in the adjusted position, for adjusting the rake angle, said first carriage (21) supporting said spindle (22) is arranged to be pivoted around said third axis ($D_2$), said grinding head (15) having a vertical axis ($Z_1$), said third axis ($D_2$) intersecting said vertical axis ($Z_1$) of said grinding head at right angles, and a second carriage (25) supporting said first carriage (21) linearly displaceable at a grinding head column (13) arranged axially parallel relative to t he vertical axis ($Z_1$) of said grinding head.

2. Grinding head, as set forth in claim 1, wherein said first carriage (21) supporting said spindle is supported for pivotal movement about the first point ($D_3$) on the first axis ($Y_2$) for adjusting an angle of inclination (K) of a radially outer annular part surface relative to a planar central part surface of said grinding disc.

3. Grinding head, as set forth in claim 1, wherein the adjustment of said third axis ($D_2$) is effected by adjustment means for the adjustment of said grinding head column in the vertical direction ($Z_1$).

4. Grinding head, as set forth in claim 1, wherein the adjustment of a pivot point on said third axis ($D_1$) of said grinding head (15) and of the tool center point ($D_1$) on a common vertical axis ($A_1$) is effected by adjusting means for moving said grinding head column along a fourth axis ($Y_1$) extending horizontally.

5. Grinding head, as set forth in claim 1, wherein said grinding means comprises an adjustable grinding disc (23), the adjustment of said grinding disc (23) in a fixed adjustable position along another vertical axis ($Z_2$, ) is effected by a carriage unit (27, 29) supported at a supporting arm (11) of said grinding head column (13) and supporting said second carriage for pivotal adjustment.

* * * * *